US010979827B2

(12) United States Patent
Norgaard et al.

(10) Patent No.: US 10,979,827 B2
(45) Date of Patent: Apr. 13, 2021

(54) METHOD OF ESTIMATING A FEEDBACK PATH OF A HEARING AID AND A HEARING AID

(71) Applicant: WIDEX A/S, Lynge (DK)

(72) Inventors: Peter Magnus Norgaard, Varlose (DK); Michael Ungstrup, Allerod (DK); Thilo Volker Thiede, Copenhagen (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 16/498,266

(22) PCT Filed: Mar. 23, 2018

(86) PCT No.: PCT/EP2018/057443

§ 371 (c)(1),
(2) Date: Sep. 26, 2019

(87) PCT Pub. No.: WO2018/177927

PCT Pub. Date: Oct. 4, 2018

(65) Prior Publication Data

US 2020/0107138 A1 Apr. 2, 2020

(30) Foreign Application Priority Data

Mar. 31, 2017 (DK) ..... PA201700227

(51) Int. Cl.
*H04R 25/00* (2006.01)
*G10L 25/21* (2013.01)

(52) U.S. Cl.
CPC ..... *H04R 25/453* (2013.01); *G10L 25/21* (2013.01); *H04R 25/30* (2013.01)

(58) Field of Classification Search
CPC ..... H04R 25/453; H04R 25/505; H04R 3/04; H04R 25/30; H04R 2430/03; H04R 25/70; H04R 29/00; H04R 29/001; H04R 29/004; H04R 2420/07; H04R 27/00; H04R 2499/15; H04R 25/552; H04R 25/75; H04R 1/1083; H04R 2410/05; H04R 2460/01; H04R 2499/11; H04R 25/305;
(Continued)

(56) References Cited

U.S. PATENT DOCUMENTS 8,385,864 B2 * 2/2013 Dickson ..... H03H 21/0012 455/130
9,179,223 B2 * 11/2015 Van Der Werf ..... H04R 25/453
(Continued)

FOREIGN PATENT DOCUMENTS

EP 2 205 005 A1 7/2010
EP 2205005 * 7/2010 ..... H04R 25/00
EP 3 002 959 A1 4/2016

OTHER PUBLICATIONS

Brian D. Woodruff, et al., "Fixed Filter Implementation of Feedback Cancellation for In-the-Ear Hearing Aids", Applications of Signal Processing to Audio And Acoustics, Oct. 15, 1995, pp. 22-23.
(Continued)

*Primary Examiner* — Lun-See Lao
(74) *Attorney, Agent, or Firm* — Sughrue Mion, PLLC

(57) ABSTRACT

A method of estimating a feedback path of a hearing aid (200). The invention also relates to a hearing aid (200) adapted to carry out said method.

14 Claims, 1 Drawing Sheet

(58) Field of Classification Search
CPC ..... H04R 25/606; H04R 3/005; H04R 3/02; H04R 3/12; H04R 5/04; A61B 5/0482; A61B 5/4064; A61B 5/04012; A61B 5/0478; A61B 5/6803; A61B 5/7264; A61B 2560/0242; A61B 2562/0209; A61B 5/0205; A61B 5/04001; A61B 5/0476; A61B 5/055; A61B 5/128; A61B 5/165; A61B 5/4088; A61B 5/4094; A61B 5/4836; A61B 5/486; A61B 5/6868; A61B 5/7246; A61B 5/726; A61B 5/04008; A61B 5/048; A61B 5/7405; A61B 5/742; A61B 5/7455; A61B 17/0206; A61B 17/025; A61B 17/0293; A61B 17/12136; A61B 2017/00172; A61B 2017/00398; A61B 2017/00544; A61B 2017/00557; A61B 2017/00734; A61B 2017/025; H04K 3/825; H04K 3/42; H04K 3/43; H04K 3/45; H04K 2203/16; H04K 2203/36; H04K 3/94; H04S 3/00; H04S 1/002; H04S 2400/15; H04S 2420/01; H04S 7/302; G10L 19/018; G10L 21/0264; G10L 21/0208; G10L 21/0332; G10L 21/00; G10L 21/0232; G10L 21/0388; G10L 25/21; G10L 25/69; H04B 17/24; H04B 7/0413; H04B 7/0452; H04B 7/0617; H04B 7/0619; H04B 7/063; H04B 7/0854; H04B 10/291; H04B 17/21; H04B 7/0695; H04B 7/088; H04B 7/15585; H04L 2025/037; H04L 2025/03713; H04L 2025/03732; H04L 25/03057; H04L 25/03108
USPC ..... 381/71.1–71.8, 71.11–71.14, 312, 320, 381/317, 318, 83, 58, 60
See application file for complete search history.

(56) References Cited

U.S. PATENT DOCUMENTS

| | | | | |
|---|---|---|---|---|
| 2006/0291681 | A1* | 12/2006 | Klinkby | H04R 25/453 381/318 |
| 2008/0095389 | A1* | 4/2008 | Theverapperuma | H04R 25/453 381/318 |
| 2008/0273728 | A1* | 11/2008 | Klinkby | H04R 25/453 381/318 |
| 2009/0017784 | A1 | 1/2009 | Dickson et al. | |
| 2011/0103613 | A1 | 5/2011 | Van Der Werf et al. | |
| 2017/0188161 | A1* | 6/2017 | Perman | H04R 25/453 |

OTHER PUBLICATIONS

International Search Report for PCT/EP2018/057443 dated Jun. 8, 2018 [PCT/ISA/210].
Written Opinion for PCT/EP2018/057443 dated Jun. 8, 2018 [PCT/ISA/237].

* cited by examiner

METHOD OF ESTIMATING A FEEDBACK PATH OF A HEARING AID AND A HEARING AID

The present invention relates to a method of estimating a feedback path of a hearing aid. The present invention also relates to a hearing aid adapted to carry out said method.

BACKGROUND OF THE INVENTION

Generally a hearing aid system according to the invention is understood as meaning any device which provides an output signal that can be perceived as an acoustic signal by a user or contributes to providing such an output signal, and which has means which are customized to compensate for an individual hearing loss of the user or contribute to compensating for the hearing loss of the user. They are, in particular, hearing aids, which can be worn on the body or by the ear, in particular on or in the ear, and which can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context, a traditional hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context, a hearing aid system may comprise a single hearing aid (a so-called monaural hearing aid system) or comprise two hearing aids, one for each ear of the hearing aid user (a so-called binaural hearing aid system). Furthermore, the hearing aid system may comprise an external device, such as a smart phone having software applications adapted to interact with other devices of the hearing aid system. Thus within the present context the term "hearing aid system device" may denote a hearing aid or an external device.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids, a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Acoustic and mechanical feedback from a receiver to one or more microphones will limit the maximum amplification that can be applied in a hearing aid. Due to the feedback, the amplification in the hearing aid can cause resonances, which shape the spectrum of the output of the hearing aid in undesired ways and even worse, it can cause the hearing aid to become unstable, resulting in whistling or howling. The hearing aid usually employs compression to compensate hearing loss; that is, the amplification gain is reduced with increasing sound pressures. Moreover, an automatic gain control is commonly used on the output to limit the output level, thereby avoiding clipping of the signal. In case of instability, these compression effects will eventually make the system marginally stable, thus producing a howl or whistle of nearly constant sound level.

Feedback suppression is often used in hearing aids to compensate the acoustic and mechanical feedback. The acoustic feedback path can change dramatically over time as a consequence of, for example, amount of earwax, the user wearing a hat or holding a telephone to the ear or the user is chewing or yawning. For this reason it is customary to apply an adaptation mechanism on the feedback suppression to account for the time-variations.

An adaptive feedback suppression filter can be implemented in a hearing aid in several different ways. For example, it can be an Infinite Impulse Response (IIR) filter or a Finite Impulse Response (FIR) filter or a combination of the two. It can be composed of a combination of a fixed filter and an adaptive filter. The adaptation mechanism can be implemented in several different ways, for example algorithms based on Least Mean Squares (LMS), Normalized Least Mean Squares (NLMS) or Recursive Least Squares (RLS).

However, it is still generally preferred to carry out an estimation of the feedback path (which in the following may also be denoted a feedback test) either as part of the initial fitting of a hearing aid system to an individual user or on request from a user or in response to an automatic detection of specific conditions that make it advantageous to carry out the feedback test again, due to a significantly changed feedback path.

Above, and in the following the term "feedback" is construed to cover both mechanical and acoustic feedback, which makes good sense because the two types of feedback are both estimated and compensated in the same manner in the hearing aid system context.

Reference is first made to FIG. 1, which illustrates highly schematically a hearing aid 100 with an adaptive feedback suppression filter 104 according to the prior art. The hearing aid basically comprises microphone 101, hearing aid processor 102, receiver 103 and adaptive feedback suppression filter 104. In FIG. 1, the level of the input signal 105 is compensated by subtraction of the level of the feedback suppression signal 106. The resulting signal 107 is used as input signal for the hearing aid processor 102 and control signal for the adaptive feedback suppression filter 104. The output signal 108 from the hearing aid processor 102 is used as input signal for the receiver 103 and input signal for the adaptive feedback suppression filter 104, thus the adaptive feedback suppression filter 104 is inserted in a feedback path of the hearing aid 100.

It has been suggested to use an adaptive feedback suppression filter to estimate the feedback path. This may be done by playing an audio test signal using the hearing aid and with the hearing aid inserted in the users ear and in response hereto allowing the adaptive feedback suppression filter to adapt until a stable condition is reached, and the hereby obtained coefficients of the adaptive feedback suppression filter constitutes the result of the feedback test. However, this approach may take a while and because some hearing aid users find the feedback test uncomfortable (due to the loud sounds played) it is desirable to reduce the duration of the test.

EP-A1-3002959 discloses a method directed at improving the adaptation rate of an adaptive algorithm, based on using a feedback test signal comprising a perfect or almost perfect sequence. However, even if improved an adaptive method for feedback path estimation will tend to be relatively slow compared to analytical methods. Additionally, it may be advantageous to omit adaptive algorithms in order to reduce system complexity and power consumption.

It is therefore a feature of the present invention to provide an improved method of estimating a feedback path of a hearing aid.

It is another feature of the present invention to provide a hearing aid adapted to provide such a method.

SUMMARY OF THE INVENTION

The invention, in a first aspect, provides a method of estimating a feedback path of a hearing aid comprising the steps of:

- storing, in a memory of the hearing aid, at least one of a measure of the energy of a feedback test signal and an autocorrelation matrix based on a feedback test signal or a characteristic of a feedback suppression filter;
- performing an in-situ feedback test by providing the feedback test signal, represented by an output signal vector x(n), using an output transducer of the hearing aid and measuring the resulting input signal using an input transducer of the hearing aid and hereby providing an input signal vector y(n) representing the measured input signal samples;
- using an analytical expression to determine a feedback suppression filter vector $\hat{h}$ based on the output signal vector x(n), the corresponding samples of the input signal vector y(n) and at least one of the measure of the energy of the feedback test signal and the autocorrelation matrix based on the feedback test signal or the characteristic of the feedback suppression filter, wherein the feedback suppression filter vector $\hat{h}$ comprises the filter coefficients of the feedback suppression filter;
- operating the hearing aid with a feedback suppressing system comprising the feedback suppression filter that is at least initially set with the determined filter coefficients.

This provides an improved method of estimating a feedback path of a hearing aid with respect to especially speed.

The invention, in a second aspect, provides a hearing aid comprising:

an input transducer, a signal processor, an output transducer, a feedback suppression filter inserted in a feedback path, and a non-volatile memory, wherein the non-volatile memory comprises at least one of a measure of the energy of a feedback test signal and an autocorrelation matrix based on a feedback test signal or a characteristic of a feedback suppression filter, and wherein the signal processor is configured to:

- perform an in-situ feedback test by providing the feedback test signal, represented by an output signal vector x(n), using an output transducer of the hearing aid and measuring the resulting input signal using an input transducer of the hearing aid and hereby providing an input signal vector y(n) representing the measured input signal samples;
- use an analytical expression to determine a feedback suppression filter vector $\hat{h}$ based on the output signal vector x(n), the corresponding samples of the input signal vector y(n) and at least one of the measure of the energy of the feedback test signal and the autocorrelation matrix based on the feedback test signal or the characteristic of the feedback suppression filter, wherein the feedback suppression filter vector $\hat{h}$ comprises the filter coefficients of the feedback suppression filter; and
- operate the hearing aid with a feedback suppressing system comprising the feedback suppression filter that is at least initially set with the determined filter coefficients.

This provides a hearing aid with improved means for estimating a feedback path.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

The present idea is based on an improved feedback test wherein the filter coefficients of the adaptive feedback suppression filter is determined based on a simple and very fast measurement. Thus the present idea distinguishes the prior art in that the filter coefficients are determined based on a calculation as opposed to prior art methods that rely on allowing an adaptive feedback suppression filter to adapt in response to a provided audio test signal until a predetermined convergence criteria is fulfilled and then using the filter coefficients that led to this convergence as the result of the feedback test.

Figure 1:
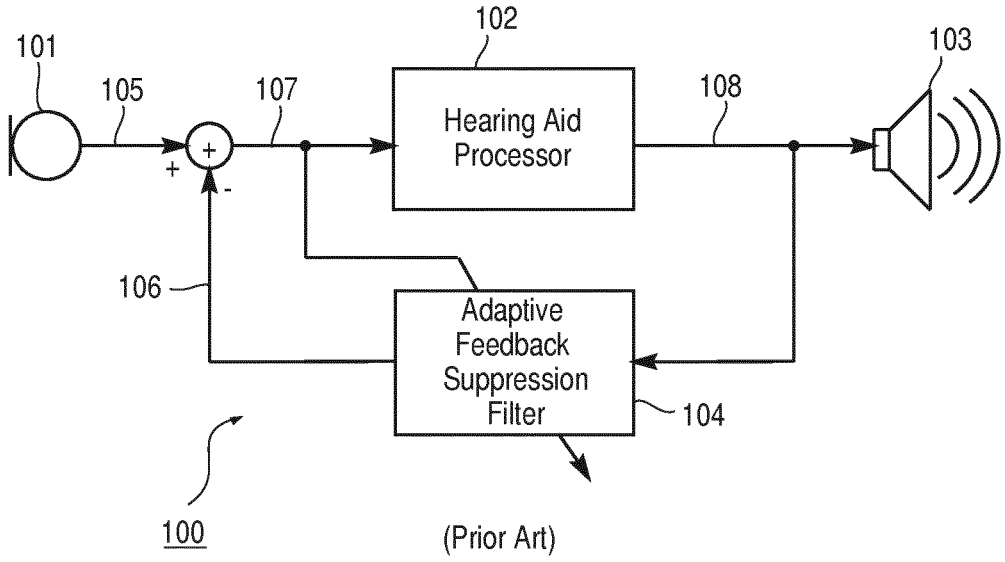
FIG. 1 illustrates highly schematically a hearing aid according to the prior art.
Figure 2:
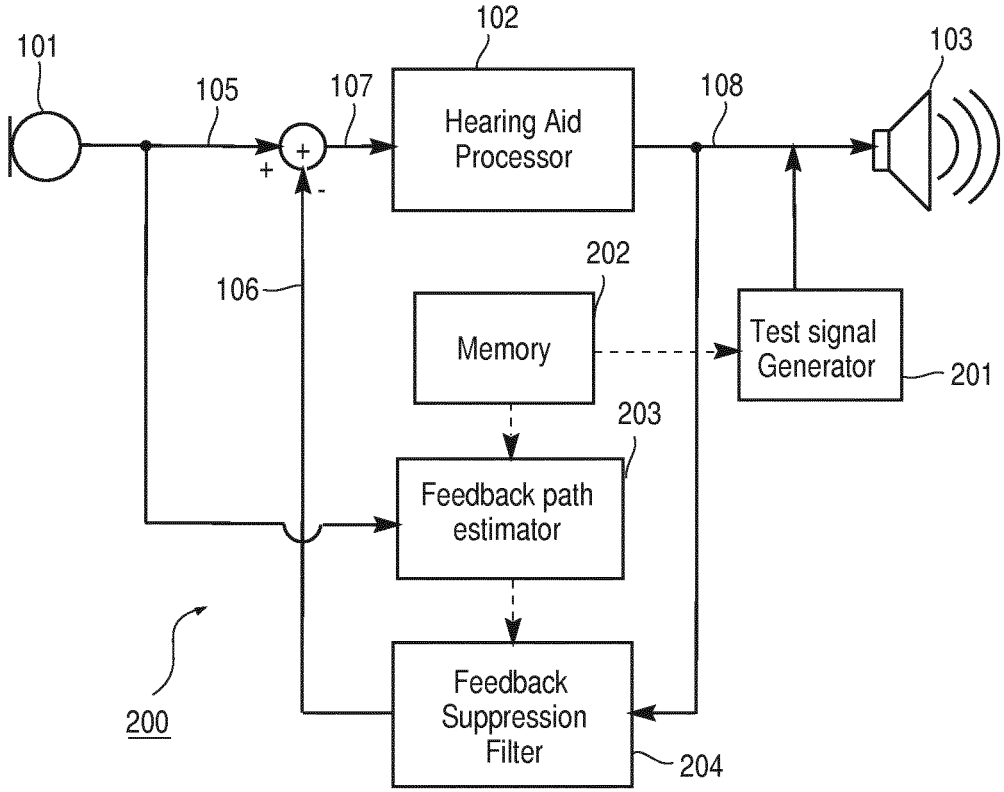
FIG. 2 illustrates highly schematically a hearing aid according to an embodiment of the invention.

Reference is now given to FIG. 2, which illustrates highly schematically a hearing aid 200 according to an embodiment of the invention. The hearing aid 200 is similar to the hearing aid 100 illustrated in FIG. 1 and the components that basically are the same will not be described further and will maintain the numbering given in FIG. 1.

In addition to the previously mentioned components the hearing aid 200 comprises a test signal generator 201, a memory 202, a feedback estimator 203 and a feedback suppression filter 204. The feedback suppression filter 204 distinguishes the corresponding component in FIG. 1 in that it is not an adaptive filter. However in variations the feedback suppression filter 204 may be adaptive and in that case the estimated feedback suppression filter coefficients are just used as a starting point for the adaptive filter.

Consider now a feedback suppression filter vector $h=[h(\mathbf{0}), h(\mathbf{1}), \ldots h(K-1)]^T$ that represents filter coefficients of the feedback suppression filter 204, an output signal vector $x_n=[x(n), x(n-1), \ldots x(n-K+1)]^T$ that represents at least a part of a feedback test signal (and in the following the terms feedback test signal and output signal vector may therefore be used interchangeably) and an input signal vector $y=[y(\mathbf{0}), y(\mathbf{1}), \ldots y(N-1)]$ comprising input signal samples measured by the input transducer 101 in response to the feedback test signal being provided by the output transducer 103.

Assuming that the feedback suppression filter 204 is a linear filter, such as a FIR filter, then the desired filtering function may be expressed as:

$$y(n) = \sum_{k=0}^{K-1} h(k)x(n-k) = h^T x_n;$$

and assuming that a multitude of corresponding feedback test signals and measured input signal samples are determined then the input signal vector y may be given as:

$$y=h^T X;$$

wherein $X=[x_0, x_1, \ldots x_{N-1}]$ and wherein X in the following may be denoted the output signal matrix. It follows directly that the output signal matrix is formed by horizontal concatenation of N output signal vectors and according to the present embodiment each of the output signal vectors represent at least a part of the feedback test signal.

Now, the above equations represent the ideal case where the optimum filter coefficient vector is known. However, in reality an estimate of this optimum filter coefficient vector need to be determined and this can be done by minimizing the squared error E between the estimated input signal samples $\hat{y}(n)$, provided by the estimated filter coefficient vector $\hat{h}$, and the real input signal samples y(n):

$$E = \frac{1}{2}\sum_{N=0}^{N-1} (y(n) - \hat{y}(n))^2 = \frac{1}{2}\sum_{n=0}^{N-1} \left(y(n) - \hat{h}^T x_n\right)^2;$$

Wherefrom the estimated filter coefficient vector $\hat{h}$ may be determined:

$$\frac{\partial E}{\partial \hat{h}} = \sum_{n=0}^{N-1} \left(y(n) - \hat{h}^T x_n\right) x_n = 0;$$

$$\leftrightarrow \hat{h} = (XX^T)^{-1} Xy^T;$$

Wherein $XX^T$ is the autocorrelation matrix for the output signal vector $x_n$ and wherein $Xy^T$ is a crosscorrelation between the output and input signal vectors.

The output signal vector $x_n$ and hereby also the output signal matrix X are selected and therefore known in advance, whereby the inverse autocorrelation matrix $(XX^T)^{-1}$ may be calculated off-line and stored in the memory 202 of the hearing aid 200. Preferably the output signal vector $x_n$ is also stored in the memory of the hearing aid 200, whereby the feedback test signal need not be streamed from an external device and to the hearing aid because the hearing aid is capable of generating the desired feedback test signal internally based on the stored output signal vector $x_n$. Thus, the hearing aid 200 is configured to, in response to a trigger event, activate the test signal generator 201 in order to provide the feedback test signal through the output transducer 103. However, in a variation the feedback test signal may be generated internally in the hearing 200 and in this case the hearing aid is adapted to calculate the inverse autocorrelation matrix $(XX^T)^{-1}$ internally.

The crosscorrelation between the output and input signal vectors may also be determined in a simple manner by the feedback path estimator 203 based on input signal samples y(n) measured in response to a provided feedback test signal.

By having the inverse autocorrelation matrix $(XX^T)^{-1}$ stored in the memory 202 the processing resources and time required to determine the feedback suppression filter coefficients may be reduced compared to previously known methods.

The inventors have found that the feedback test may be carried out in less than 3 seconds generally and the duration may be as short as 1 second. in many cases the duration is approximately 1 second.

It is specifically advantageous to apply the present invention, when the feedback suppression filter is a high order filter (i.e. has many filter coefficients), because the relative amount of additional time required to carry out the feedback test using an adaptive algorithm increases with the order of the filter.

According to an especially advantageous embodiment the feedback test signal provided by the output signal vector is white noise such as Maximum Length Sequence (MLS) noise. By applying this type of feedback test signal the resulting autocorrelation matrix $XX^T$ becomes a scaled identity matrix and consequently the estimated filter coefficient vector $\hat{h}$ may be determined as:

$$\hat{h}=(P)^{-1}Xy^T;$$

wherein P is a measure of the energy of the known white noise feedback test signal as represented by the output signal vectors. Thus according to this embodiment it is only required to store the measure of the energy of the feedback test signal instead of the whole autocorrelation matrix of the output signal vector.

It has been found that the estimated filter coefficient vector $\hat{h}$ may be determined with a sufficiently high precision based only on a white noise feedback test signal, so that single test tones can be used, which will improve perceived comfort during the feedback test for at least some users.

Generally the linear feedback suppression filter 204 may be of any type, such as an IIR filter.

According to an alternative embodiment the feedback suppression filter 204 is a warped FIR filter, i.e. a filter with a frequency dependent delay and thereby a non-uniform frequency resolution as opposed to the traditional FIR filter that provides a uniform frequency resolution. In this context it is advantageous to apply a warped filter because it allows a good match to the response of the human auditory system. According to a specific embodiment the non-uniform frequency resolution of the warped filter is designed to match the psychoacoustic Bark scale.

A warped filter is characterized in that the transfer function $D_k(z)$ between each node of the delay line is frequency dependent (i.e. dispersive) as opposed to the unit delay provided between the nodes of the delay line of a traditional FIR filter. In the following the warped filter may also be denoted a warped delay line.

Consider now a warped filter matrix W defined as:

$$W=[w_0, w_1, \ldots w_{K-1}]$$

wherein the vectors $w_k$ represent the impulse responses of the transfer functions characterizing the delay line of the warped filter. Thus the warped filter matrix is formed by horizontal concatenation of vectors representing impulse responses characterizing the warped filter delay line.

Following the same procedure as outlined above for the FIR filter implementation we find that an estimate $\widehat{\boldsymbol{h}_w}$ of the warped filter coefficient vector may be determined as:

$$\widehat{\boldsymbol{h}_w}=(W^TXX^TW)^{-1}(W^TX)y^T;$$

wherein $(W^TX)y^T$ represents a modified crosscorrelation matrix between the output and input signal vectors.

In analogy with the FIR filter embodiment it may be selected to use white noise as feedback test signal whereby the estimate $\widehat{\boldsymbol{h}_w}$ of the warped filter coefficient vector may be determined as:

$$\widehat{\boldsymbol{h}_w}=(P)^{-1}(W^TW)^{-1}(W^TX)y^T;$$

The warped filter matrix W is known in advance and it is therefore possible to calculate off-line the autocorrelation matrix of the warped filter matrix $W^T W$ or the inverse of the autocorrelation matrix of the warped filter matrix $(W^TW)^{-1}$ and store the result in the memory 202 of the hearing aid 200. In an obvious variation the warped filter matrix W itself may also be stored in the memory 202 in order to facilitate the calculation of the modified crosscorrelation matrix.

In another variation the inventors have realized that the autocorrelation matrix of the warped filter matrix can be expressed in the form of a Kac-Murdock-Szegö (KMS) matrix which is particularly simple to invert, whereby the inverse of the autocorrelation matrix of the warped filter matrix can be calculated off-line and stored in the memory 202 of the hearing aid 200 as a relatively simple expression.

It should be appreciated that the disclosed embodiments of the invention are characterized in that an autocorrelation matrix or a measure derived from the autocorrelation matrix are stored in a memory of a hearing aid whereby the filter coefficients for a feedback suppression filter may be determined independently by the hearing aid as part of a feedback test of short duration.

In the present context, an autocorrelation matrix is construed to cover matrices that primarily consists of elements of the discrete autocorrelation function.

In further variations the methods and selected parts of the hearing aid according to the disclosed embodiments may also be implemented in systems and devices that are not hearing aid systems (i.e. they do not comprise means for compensating a hearing loss), but nevertheless comprise both acoustical-electrical input transducers and electro-acoustical output transducers. Such systems and devices are at present often referred to as hearables. However, a headset is another example of such a system.

In still other variations the invention is embodied as a non-transitory computer readable medium carrying instructions which, when executed by a computer, cause the methods of the disclosed embodiments to be performed.

Other modifications and variations of the structures and procedures will be evident to those skilled in the art.

The invention claimed is:

1. A method of estimating a feedback path of a hearing aid comprising the steps of:

storing, in a memory of the hearing aid, at least one of a measure of the energy of a feedback test signal and an autocorrelation matrix based on a feedback test signal or a characteristic of a feedback suppression filter;

performing an in-situ feedback test by providing the feedback test signal, represented by an output signal vector x(n), using an output transducer of the hearing aid and measuring the resulting input signal using an input transducer of the hearing aid and hereby providing an input signal vector y(n) representing the measured input signal samples;

using an analytical expression to determine a feedback suppression filter vector $\hat{h}$ based on the output signal vector x(n), the corresponding samples of the input signal vector y(n) and at least one of the measure of the energy of the feedback test signal and the autocorrelation matrix based on the feedback test signal or the characteristic of the feedback suppression filter, wherein the feedback suppression filter vector $\hat{h}$ comprises the filter coefficients of the feedback suppression filter;

operating the hearing aid with a feedback suppressing system comprising the feedback suppression filter that is at least initially set with the determined filter coefficients.

2. The method according to claim 1, wherein the feedback test signal is a white noise signal.

3. The method according to claim 1, wherein the output signal vector represents a Maximum Length Sequence noise signal.

4. The method according to claim 1, wherein the feedback test signal does not comprise parts consisting only of a pure tone.

5. The method according to claim 1, wherein the analytical expression used to determine the feedback suppression filter vector is derived by using a Least Mean Square approach.

6. The method according to claim 2, wherein the analytical expression used to determine the feedback suppression filter vector $\hat{h}$ is given as:

$$\hat{h}=(P)^{-1}Xy^T$$

wherein $y^T$ is the transposed input signal vector, X is an output signal matrix formed by at least one output signal vector and P is the measure of the feedback test signal energy.

7. The method according to claim 1, wherein the analytical expression used to determine the feedback suppression filter vector $\hat{h}$ is given as:

$$\hat{h}=(W^TXX^TW)^{-1}(W^TX)y^T$$

wherein $y^T$ is the transposed input signal vector, wherein X is an output signal matrix formed by at least one output signal vector, wherein W is a warped filter matrix and wherein the feedback suppression filter is a warped filter.

8. The method according to claim 2, wherein the analytical expression used to determine the feedback suppression filter vector $\hat{h}$ is given as:

$$\hat{h}=(P)^{-1}(W^TW)^{-1}(W^TX)y^T$$

wherein the feedback suppression filter is a warped filter, wherein P is the measure of the feedback test signal energy, wherein $y^T$ is the transposed input signal vector, wherein X is an output signal matrix formed by at least one output signal vector, wherein W is a warped filter matrix representing characteristics of a delay line of the warped feedback suppression filter and wherein $(W^TW)^{-1}$ is the inverse of an autocorrelation matrix of the warped filter matrix.

9. The method according to claim 8, wherein the inverse autocorrelation matrix of the warped filter matrix $(W^TW)^{-1}$ is expressed in the form of a KMS matrix and is stored in the memory of the hearing aid.

10. A hearing aid comprising an input transducer, a signal processor, an output transducer, a feedback suppression filter inserted in a feedback path, and a non-volatile memory, wherein the non-volatile memory comprises at least one of a measure of the energy of a feedback test signal and an autocorrelation matrix based on a feedback test signal or a characteristic of a feedback suppression filter, and wherein the signal processor is configured to:

perform an in-situ feedback test by providing the feedback test signal, represented by an output signal vector x(n), using an output transducer of the hearing aid and measuring the resulting input signal using an input transducer of the hearing aid and hereby providing an input signal vector y(n) representing the measured input signal samples;

use an analytical expression to determine a feedback suppression filter vector $\hat{h}$ based on the output signal vector x(n), the corresponding samples of the input signal vector y(n) and at least one of the measure of the energy of the feedback test signal and the autocorrelation matrix based on the feedback test signal or the characteristic of the feedback suppression filter, wherein the feedback suppression filter vector $\hat{h}$ comprises the filter coefficients of the feedback suppression filter; and operate the hearing aid with a feedback suppressing system comprising the feedback suppression filter that is at least initially set with the determined filter coefficients.

11. The hearing aid according to claim 10, wherein the feedback test signal is a white noise signal.

12. The hearing aid according to claim 11 wherein the analytical expression used to determine the feedback suppression filter vector $\hat{h}$ is given as:

$$\hat{h}=(P)^{-1}Xy^T$$

wherein $y^T$ is the transposed input signal vector, X is an output signal matrix formed by at least one output signal vector and P is the measure of the feedback test signal energy.

13. The hearing aid according to claim 11, wherein the analytical expression used to determine the feedback suppression filter vector $\hat{h}$ is given as:

$$\hat{h}_w=(P)^{-1}(W^TW)^{-1}(W^TX)y^T$$

wherein the feedback suppression filter is a warped filter, wherein P is the measure of the feedback test signal energy, wherein $y^T$ is the transposed input signal vector, wherein X is an output signal matrix formed by at least one output signal vector, wherein W is a warped filter matrix representing characteristics of a delay line of the warped feedback suppression filter and wherein $(W^TW)^{-1}$ is the inverse of an autocorrelation matrix of the warped filter matrix.

14. The hearing aid according to claim 10, wherein the analytical expression used to determine the feedback suppression filter vector $\hat{h}$ is given as:

$$\hat{h}=(W^TXX^TW)^{-1}(W^TX)y^T$$

wherein $y^T$ is the transposed input signal vector, wherein X is an output signal matrix formed by at least one output signal vector, wherein W is a warped filter matrix and wherein the feedback suppression filter is a warped filter.

* * * * *